US010248052B2

(12) United States Patent
Kashihara et al.

(10) Patent No.: US 10,248,052 B2
(45) Date of Patent: Apr. 2, 2019

(54) RESISTANCE DETECTION UNIT AND IMAGE FORMING APPARATUS COMPRISING THE SAME

(71) Applicant: FUJI XEROX CO., LTD., Tokyo (JP)

(72) Inventors: Mabumi Kashihara, Kanagawa (JP); Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/714,479

(22) Filed: Sep. 25, 2017

(65) Prior Publication Data

US 2018/0275567 A1 Sep. 27, 2018

(30) Foreign Application Priority Data

Mar. 22, 2017 (JP) ..... 2017-056222

(51) Int. Cl.
*G03G 15/00* (2006.01)
*G03G 15/16* (2006.01)

(52) U.S. Cl.
CPC ..... *G03G 15/16* (2013.01); *G03G 15/1605* (2013.01); *G03G 15/5029* (2013.01); *G03G 15/6517* (2013.01)

(58) Field of Classification Search
CPC ..... G03G 15/16; G03G 15/5029
See application file for complete search history.

(56) References Cited

U.S. PATENT DOCUMENTS 6,223,004 B1 * 4/2001 Kodama ..... G03G 15/065 399/44
2004/0047641 A1 * 3/2004 Kato ..... G03G 15/1675 399/45
2007/0172244 A1 * 7/2007 Lee ..... G03G 15/1675 399/45
2008/0124103 A1 * 5/2008 Uchida ..... G03G 15/166 399/45
2010/0067925 A1 * 3/2010 Mori ..... G03G 15/235 399/15
2011/0311252 A1 * 12/2011 Watanabe ..... G03G 15/1675 399/45
2012/0013694 A1 * 1/2012 Kanke ..... B41J 2/0057 347/103
2012/0224873 A1 * 9/2012 Aoki ..... G03G 15/161 399/66
2017/0357193 A1 * 12/2017 Ochi ..... G03G 15/1665

FOREIGN PATENT DOCUMENTS

JP 2012-118408 A 6/2012
JP 5832125 B2 12/2015

* cited by examiner

*Primary Examiner* — Rodney A Bonnette
(74) *Attorney, Agent, or Firm* — Sughrue Mion, PLLC

(57) ABSTRACT

An image forming apparatus includes a transfer unit, a resistance detection unit, and a changing unit. The transfer unit transfers an image to a continuous recording medium. The resistance detection unit detects a resistance of the recording medium at a position upstream of the transfer unit in a transport direction of the recording medium. The changing unit changes a transfer condition of the transfer unit in accordance with a detection result of the resistance detection unit.

6 Claims, 10 Drawing Sheets

RESISTANCE DETECTION UNIT AND IMAGE FORMING APPARATUS COMPRISING THE SAME

CROSS-REFERENCE TO RELATED APPLICATIONS

This application is based on and claims priority under 35 USC 119 from Japanese Patent Application No. 2017-056222 filed Mar. 22, 2017.

BACKGROUND

(i) Technical Field

The present invention relates to an image forming apparatus.

(ii) Related Art

In order address the needs of diversification of recording media on which images are formed, image forming apparatuses that form images on continuous recording media as recording media have already been commercialized. For such image forming apparatuses, techniques of controlling a transfer voltage or a transfer current in accordance with changes in the recording media have been proposed.

SUMMARY

According to an aspect of the present invention, an image forming apparatus includes a transfer unit, a resistance detection unit, and a changing unit changes. The transfer unit transfers an image to a continuous recording medium. The resistance detection unit detects a resistance of the recording medium at a position upstream of the transfer unit in a transport direction of the recording medium. The changing unit changes a transfer condition of the transfer unit in accordance with a detection result of the resistance detection unit.

BRIEF DESCRIPTION OF THE DRAWINGS

Exemplary embodiments of the present invention will be described in detail based on the following figures, wherein.

DETAILED DESCRIPTION

Exemplary embodiments according of the present invention will be described below with reference to the drawings.

First Exemplary Embodiment

Figure 1:
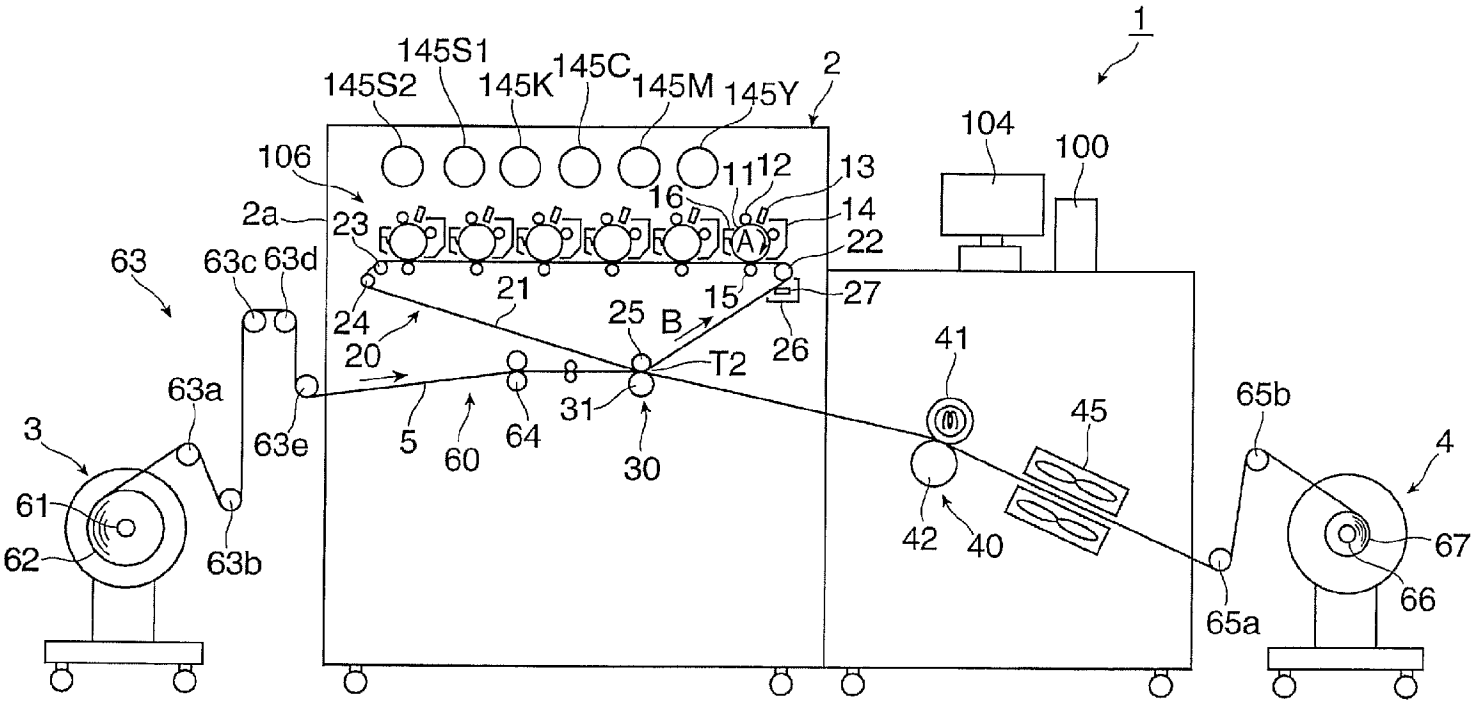
FIG. 1 is a schematic structural view of an image forming apparatus according to a first exemplary embodiment of the present invention.
Figure 2:
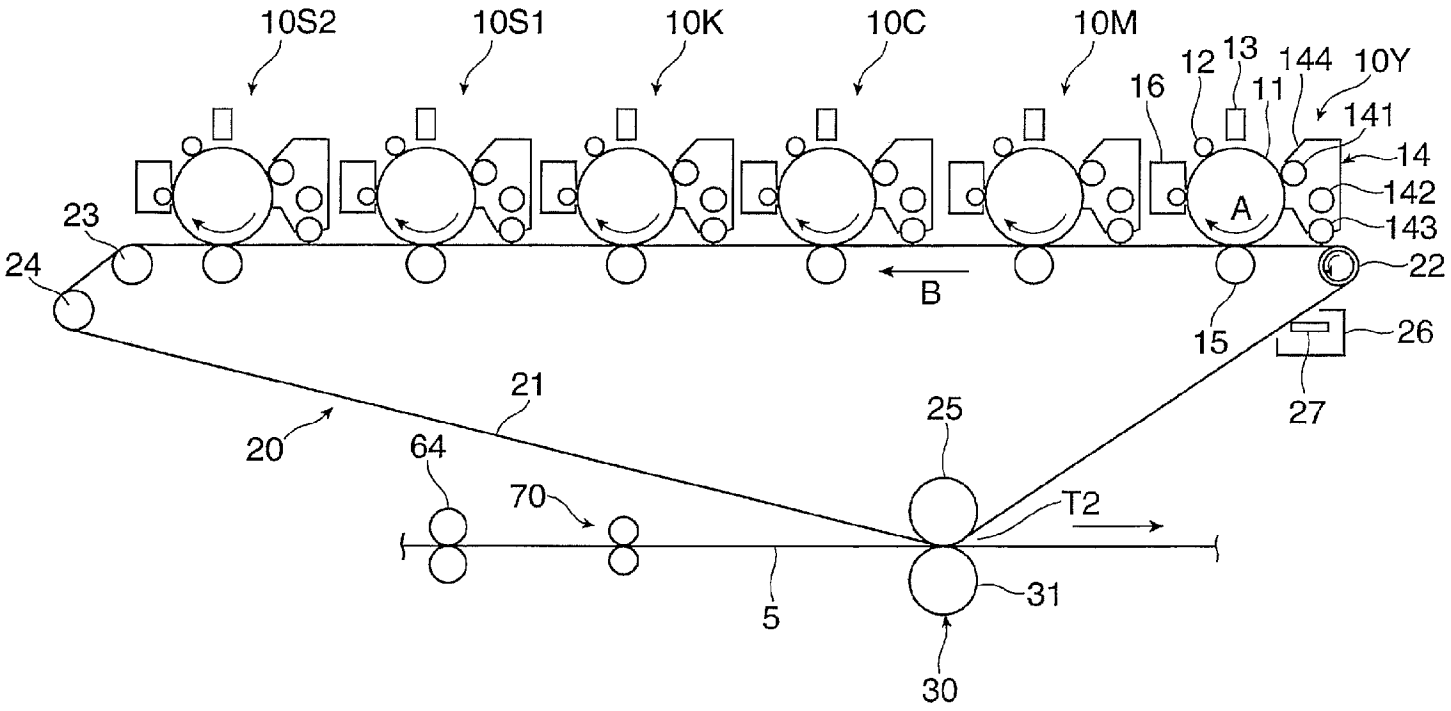
FIG. 2 is a structural view of an image forming section of the image forming apparatus according to the first exemplary embodiment of the present invention.

FIGS. 1 and 2 illustrate an image forming apparatus according to a first exemplary embodiment. FIG. 1 is a schematic overall view of the image forming apparatus. FIG. 2 is an enlarged view of parts (such as image forming devices) of the image forming apparatus.

An Overall Structure of the Image Forming Apparatus

An image forming apparatus 1 according to the first exemplary embodiment is structured as, for example, a color printer. The image forming apparatus 1 includes an image output unit 2, a paper feed device 3, a paper output device 4, and a controller 100. The image output unit 2 forms images with toners of six colors, that is, yellow (Y), magenta (M), cyan (C), black (K), a first special color (S1), and a second special color (S2). The paper feed device 3 feeds continuous paper 5 serving as an example of a continuous recording medium. The paper output device 4 causes the continuous paper 5 on which the images have been formed by the image output unit 2 to be output and receives the continuous paper 5. The controller 100 is provided in an upper portion of the image output unit 2 and controls the image output unit 2, the paper feed device 3, and the paper output device 4. In the illustrated example of the image forming apparatus 1, the paper feed device 3 and the paper output device 4 are each structured as a separate device and disposed outside the image output unit 2. However, of course, the image output unit 2, the paper feed device 3, and the paper output device 4 may be integrally disposed in the image forming apparatus 1.

The image output unit 2 includes an image forming section 106 that uses an electrophotographic system to form images on the continuous recording medium in accordance with image data. The image forming section 106 includes plural image forming devices 10, an intermediate transfer device 20, a transport device 60, and a fixing device 40. Each of the plural image forming devices 10 serves as an example of an image forming device and forms a toner image developed with the toner included in developer. The intermediate transfer device 20 holds the toner images having been formed by the image forming devices 10 and transports the toner images to a second transfer position T2 where the toner images are transferred through second transfer onto the continuous paper 5 at last. The transport device 60 transports the required continuous paper 5 to be fed to the second transfer position T2 of the intermediate transfer device 20. The fixing device 40 performs, for example, a heating step in which the toner images that have been transferred through second transfer onto the continuous paper 5 by the intermediate transfer device 20 are fixed. The fixing device 40 serves as an example of a fixing unit.

The image output unit 2 may be configured as a color copier in the case where, for example, a document reader (not illustrated) serving as an image reader that inputs document images to be formed on the continuous paper 5 is additionally provided. A housing of the image output unit 2 is indicated by numeral 2*a* illustrated in FIG. 1. The housing 2*a* includes, for example, a support structural member and an external covering.

The image forming devices 10 include six image forming devices 10Y, 10M, 10C, 10K, 10S1, and 10S2 that dedicatedly form images with the toners of the six colors, that is, yellow (Y), magenta (M), cyan (C), black (K), a first special color (S1), and a second special color (S2), respectively. These six image forming devices 10Y, 10M, 10C, 10K, 10S1, and 10S2 are arranged in a single raw in an inner space of the housing 2*a*.

In most cases, the image forming devices 10S1 and 10S2 that form toner images of the first special color (S1) and the second special color (S2) each form a toner image that the yellow (Y), magenta (M), cyan (C), and black (K) image forming devices 10Y, 10M, 10C, and 10K are unable to express such as, for example, a white toner image, a metallic-color toner image, a transparent toner image, or a foaming toner image.

As illustrated in FIG. 2, each of the image forming devices 10 includes a corresponding one of rotating photosensitive drums 11 serving as an example of an image holding member. The following devices are typically disposed around the photosensitive drum 11. The devices disposed around the photosensitive drum 11 include, for example, a charger 12, a light exposure device 13, a developing device 14, a first transfer device 15, and a drum cleaner 16. The charger 12 charges to a required potential a circumferential surface (image holding surface) of the photosensitive drum 11 on which image formation is possible. The light exposure device 13 serving as an example of an electrostatic latent image forming unit radiates light in accordance with image information (signal) toward the charged circumferential surface of the photosensitive drum 11 so as to form an electrostatic latent image (of a corresponding one of the colors) having a potential difference. The developing device 14 serving as an example of a developing section develops the electrostatic latent image with the toner of the developer of a corresponding one of the colors so as to form the toner image. The first transfer device 15 transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed.

The photosensitive drum 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in an arrow A direction by transmitting a motive force from a drive device (not illustrated).

The charger 12 includes a contact-type charger such as a charging roller disposed so as to be in contact with the photosensitive drum 11. A charging voltage is supplied to the charger 12. In the case where the developing device 14 performs reversal development, a voltage or a current the polarity of which is the same as that of the toner supplied from this developing device 14 is supplied as the charging voltage. Of course, the charger 12 may be a contactless charging device such as a corona discharger disposed in a state in which the charger 12 is not in contact with the photosensitive drum 11.

The light exposure device 13 radiates the light that is formed in accordance with the image information input to the image output unit 2 toward the circumferential surface of the charged photosensitive drum 11 so as to form the electrostatic latent image. At a time when the latent image is formed, the image information (signal) that has been input to the image output unit 2 by an arbitrary device and undergone image processing in an image processing unit is transmitted to the light exposure device 13.

Each of the developing devices 14 includes, for example, a developing roller 141, an agitating/supplying member 142, an agitating/transporting member 143, and a layer-thickness regulating member 144. These components are disposed in a developing device body that has an opening and a container chamber for the developer. The developing roller 141 holds the developer and transports the developer to a developing region facing the photosensitive drum 11. The agitating/supplying member 142 and the agitating/transporting member 143 are two screw augers or the like and transport the developer while agitating the developer so that the developer is supplied to the developing roller 141. The layer-thickness regulating member 144 regulates the amount (layer thickness) of the developer held by the developing roller 141. A developing bias voltage is supplied between the developing roller 141 of the developing device 14 and the photosensitive drum 11 from a power unit (not illustrated). Furthermore, each of the developing roller 141, the agitating/supplying member 142, and the agitating/transporting member 143 is rotated in a required direction by transmitting a motive force from rotational drive device (not illustrated). Two-component developer that includes non-magnetic toner and magnetic carrier is used as the developer.

In FIG. 1, toner cartridges serving as developer containers that contain the developers, which contain at least the respective toners, to be supplied to the corresponding developing devices 14 are denoted by numerals 145Y, 145M, 145C, 145K, 145S1, and 145S2.

Each of the first transfer devices 15 is a contact-type transfer device that includes a first transfer roller. The first transfer roller is in contact with a circumference of the photosensitive drum 11 so as to be rotated. A first transfer voltage is supplied to the first transfer roller. As the first transfer voltage, a direct-current voltage the polarity of which is opposite to the polarity to which the toner is charged is supplied from a power unit (not illustrated).

Each of the drum cleaners 16 includes, for example, a body, a cleaning plate, and a feed device. The body has a container shape and is partially open. The cleaning plate is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member collects the adhering matter removed by the cleaning plate.

As illustrated in FIGS. 1 and 2, the intermediate transfer device 20 is disposed below the image forming devices 10Y, 10M, 10C, 10K, 10S1, and 10S2. The intermediate transfer device 20 includes an intermediate transfer belt 21, plural belt support rollers 22 to 25, a second transfer device 30, and a belt cleaner 26. The intermediate transfer belt 21 is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 30 is disposed on the outer circumferential surface (image holding surface) side of the intermediate transfer belt 21 at a position where the intermediate transfer belt 21 is supported by the belt support roller 25. The second transfer device 30 transfers through the second transfer the toner images from the intermediate transfer belt 21 onto the continuous paper 5. The belt cleaner 26 includes a blade-shaped cleaning member 27 that cleans the outer circumferential surface of the intermediate transfer belt 21 by removing adhering matter such as toners or paper dust remaining on and adhering to the outer circumferential surface of the intermediate transfer belt 21 after the intermediate transfer belt 21 has passed through the second transfer device 30.

Figure 4:
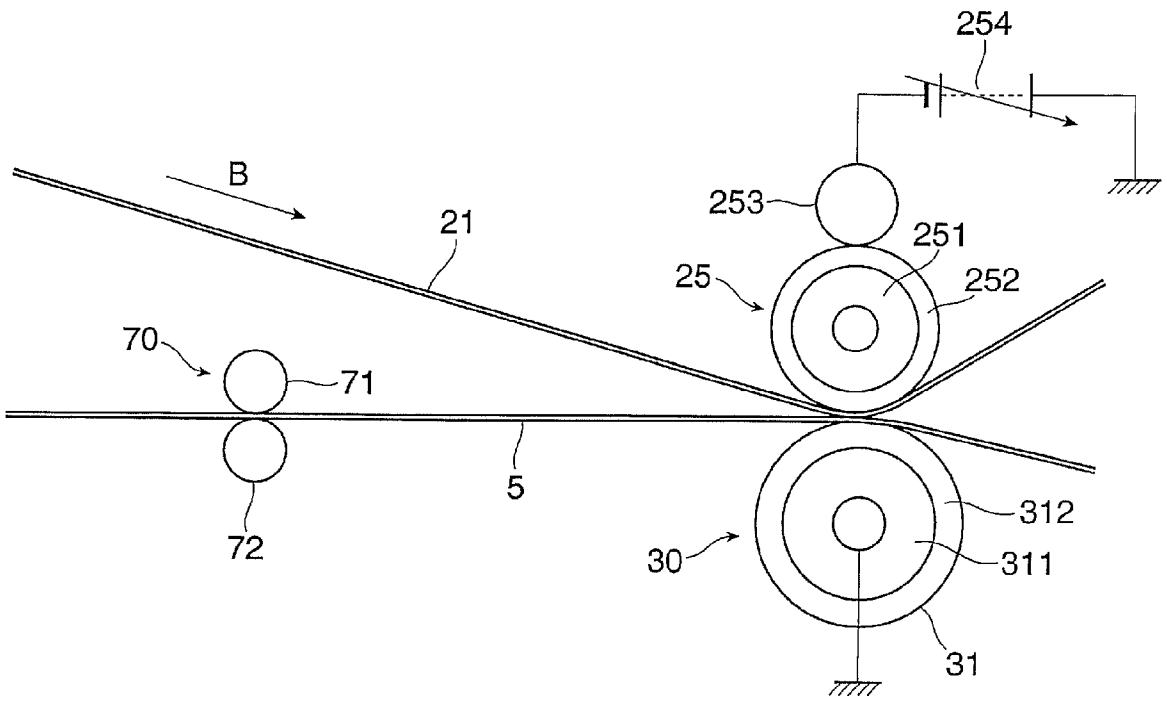
FIG. 4 is a structural view of part of the image forming section of the image forming apparatus according to the first exemplary embodiment of the present invention.

The intermediate transfer belt 21 is an endless belt formed of a material including, for example, synthetic resin such as polyimide resin or polyamide resin in which a resistance adjuster or the like such as carbon black is dispersed. Furthermore, the belt support roller 22 serves as a drive roller, the belt support roller 23 serves as a surface forming roller for the intermediate transfer belt 21, the belt support roller 24 serves as a tension applying roller for the intermediate transfer belt 21, and the belt support roller 25 is a backup roller for second transfer. As illustrated in FIG. 4, the belt support roller 25 includes a cored bar 251 formed of metal such as stainless steel and an electrically conductive elastic layer 252 coated over an outer circumference of the cored bar 251.

As illustrated in FIG. 2, the second transfer device 30 is a contact-type transfer device that includes a second transfer roller 31. The second transfer roller 31 is in contact with the circumferential surface of the intermediate transfer belt 21 so as to be rotated. The second transfer roller 31 is in contact with the circumferential surface of the intermediate transfer belt 21 at the second transfer position T2 which is part of the outer circumferential surface of the intermediate transfer belt 21 where the intermediate transfer belt 21 is supported by the belt support roller 25 of the intermediate transfer device 20. A second transfer voltage is supplied to the second transfer roller 31 at the second transfer position T2. As illustrated in FIG. 4, the second transfer roller 31 includes a cored bar 311 formed of metal such as stainless steel and an electrically conductive elastic layer 312 coated over an outer circumference of the cored bar 311. As the second transfer voltage, a direct-current voltage is supplied to the second transfer roller 31 or the support roller 25 of the intermediate transfer device 20. The polarity of this direct-current voltage is opposite to or the same as the polarity to which the toners are charged.

According to the present exemplary embodiment, as illustrated in FIG. 4, a bias applying roller 253 is in contact with the support roller 25 of the intermediate transfer device 20 such that the bias applying roller 253 is rotatable. A second transfer bias power source 254 is connected to the bias applying roller 253. The second transfer bias power source 254 applies a direct-current negative-polarity second transfer bias voltage. The polarity of the second transfer bias voltage is the same as the polarity to which the toners are charged. The second transfer bias voltage or a second transfer bias current is changeable with the second transfer bias power source 254. Furthermore, the cored bar 311 of the second transfer roller 31 is grounded.

As illustrated in FIG. 1, the fixing device 40 includes, for example, a heating rotating member 41 and a pressure rotating member 42. The heating rotating member 41 is in the form of a roller or a belt and heated by a heating unit so that the surface temperature of the heating rotating member 41 is maintained at a specified temperature. The pressure rotating member 42 is in the form of a belt or a roller and in contact with the heating rotating member 41 at a specified pressure so as to be rotated. This fixing device 40 has a contact portion where the heating rotating member 41 and the pressure rotating member 42 are in contact with each other. This contact portion serves as a fixing process portion where a required fixing process (heating and applying pressure) that includes the heating step in which the continuous paper 5 is heated is performed. Furthermore, a cooling device 45 is disposed downstream of the fixing device 40 in a transport direction of the continuous paper 5. The cooling device 45 cools the continuous paper 5 onto which the toner images have been fixed by the fixing device 40.

Figure 3A:
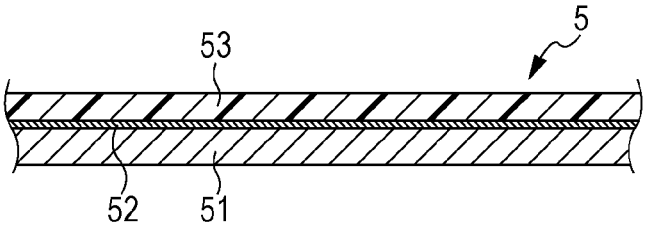
FIGS. 3A and 3B are structural sectional views of continuous paper.
Figure 3B:
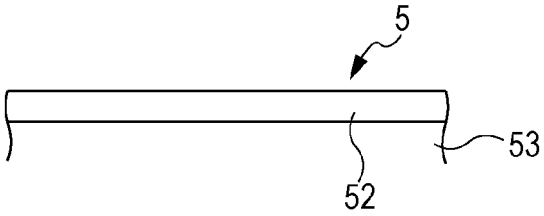

Roll paper 62 is set in the paper feed device 3. The roll paper 62 is formed by winding into a roll shape the long continuous paper 5 serving as an example of the continuous recording medium on the outer circumference of a rotational shaft 61. The paper feed device 3 feeds the continuous paper 5 from the roll paper 62. Furthermore, the paper feed device 3 as a separate device is separated from the image output unit 2 and disposed upstream of the image output unit 2 in the continuous paper 5 transport direction. As the continuous paper 5, for example, so-called label paper is used. Referring to FIG. 3A, the label paper includes release paper 51, a tacky layer 52, and a surface material 53. The release paper 51 typically serves as layout paper formed by, for example, glassine and discarded after it has been released. The tacky layer 52 formed of a tackiness agent such as glue or an adhesive serves as an intermediate layer. The surface material 53 is formed by paper such as fine paper or coated paper, or a synthetic resin sheet such as a polypropylene (PP) sheet or a polyethylene terephthalate (PET) sheet. The surface material 53 is provided uppermost and stuck onto the release paper 51 with the tacky layer 52 interposed therebetween. The label paper 5 is used with a pattern or characters printed on the surface material 53 thereof. Although it depends on application, the label paper 5 is supplied in the form of the roll paper 62 having been wound into a roll shape such that, for example, the surface material 53 side is positioned on a front surface (outer circumferential surface) side.

The continuous recording medium 5 is not limited to the label paper. The continuous recording medium may be continuous plain paper or a continuous recording medium formed of a synthetic resin film such as a polyethylene film. The type of the material of the continuous recording medium is not limited.

As illustrated in FIG. 1, the roll paper 62 is set in the paper feed device 3. The paper feed device 3 includes a tension applying unit 63. The roll paper 62 is rotated clockwise by a drive unit (not illustrated). The tension applying unit 63 applies tension to the continuous paper 5 fed as the roll paper 62 is rotated. The tension applying unit 63 includes plural transport rollers 63*a* to 63*e* that transport the continuous paper 5. Out of the plural transport rollers 63*a* to 63*e*, the transport roller 63*b* is movable in a direction separating from the transport rollers 63*a* and 63*c*, and an elastic force is applied to the transport roller 63*b*. The transport roller 63*b* applies a certain tension to the continuous paper 5 fed from the roll paper 62.

The image output unit 2 includes the transport device 60 disposed in the housing 2*a*. The transport device 60 transports the continuous paper 5 fed from the paper feed device 3 to the second transfer position T2. The transport device 60 includes a pair of transport rollers 64 (registration rollers) between which the continuous paper 5 is interposed and which transport the continuous paper 5 so as to synchronize the continuous paper 5 with the toner images on the intermediate transfer belt 21 to be transported to the second transfer position T2.

Furthermore, the paper output device 4 is disposed downstream of the image output unit 2. The paper output device 4 causes the continuous paper 5 on which the images have been formed by the image output unit 2 to be output and receives the continuous paper 5. The paper output device 4 includes plural guide rollers 65*a* and 65*b* and a take-up roller 67. The plural guide rollers 65*a* and 65*b* guide the continuous paper 5. The take-up roller 67 is disposed such that the take-up roller 67 is rotatable clockwise in FIG. 1 and winds the continuous paper 5 into a roller shape on the outer circumference of a rotational shaft 66.

Basic Operation of the Image Forming Apparatus

Basic image forming operation performed by the image output unit 2 of the image forming apparatus 1 will be described below.

Here, an image forming operation is described which is performed when a full-color image including the special colors is formed by combining toner images of the six colors (Y, M, C, K, S1, and S2) with the six image forming devices 10Y, 10M, 10C, 10K, 10S1, and 10S2 of the image output unit 2. It is noted that the image forming operation is performed similarly or in the same manner when a toner image of at least one of the six colors (Y, M, C, K, S1, and S2) is formed with the six image forming devices 10Y, 10M, 10C, 10K, 10S1, and 10S2 of the image output unit 2.

Upon reception of instruction information requesting the image forming operation (printing), the image output unit 2 starts up the six image forming devices 10Y, 10M, 10C, 10K, 10S1, and 10S2, the intermediate transfer device 20, the second transfer device 30, the fixing device 40, and so forth.

Then, in the image forming devices 10Y, 10M, 10C, 10K, 10S1, and 10S2, first, the photosensitive drums 11 are rotated in the arrow A direction, and the chargers 12 charge the surfaces of the respective photosensitive drums 11 to the required polarity (negative polarity according to the first exemplary embodiment) and the required potentials. Next, the light exposure devices 13 radiate the light emitted in accordance with image signals obtained by converting image information input to the image output unit 2 into color components (Y, M, C, K, S1, and S2) to the surfaces of the charged photosensitive drums 11. Thus, the electrostatic latent images for the color components having the required potentials are formed on the surfaces of the photosensitive drums 11.

Next, the developing devices 14Y, 14M, 14C, 14K, 14S1, and 14S2 each supply the toner of a corresponding one of the colors (Y, M, C, K, S1, and S2) charged to the required polarity (negative polarity) to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 becomes visible as the toner image of a corresponding one of the six colors (Y, M, C, K, S1, and S2) developed with the toner of the color.

Next, when the toner images of the colors formed on the photosensitive drums 11 of the image forming devices 10Y, 10M, 10C, 10K, 10S1, and 1052 are transported to the first transfer positions, the first transfer devices 15 transfer the toner images of the colors through first transfer onto the intermediate transfer belt 21 of the intermediate transfer device 20 rotated in the arrow B direction such that the toner images are sequentially superposed on one another.

Furthermore, the drum cleaners 16 clean the surfaces of the photosensitive drums 11 by removing adhering matter such as toners such that the adhering matter is scraped off from the surfaces of the photosensitive drums 11 in the image forming devices 10 where the first transfer has been performed. Thus, the image forming devices 10 are ready to perform the next image forming operation.

Next, the toner images having been transferred through the first transfer are held and transported to the second transfer position T2 by rotating the intermediate transfer belt 21 in the intermediate transfer device 20. Meanwhile, regarding the paper feed device 3 and the paper output device 4, the continuous paper 5 is introduced from the paper feed device 3 into the housing 2*a* of the image output unit 2 prior to the image forming operation, passes through the transport rollers 64 of the transport device 60, the second transfer position T2, and the fixing device 40, and is guided to the outside of the image output unit 2. Then, the leading end of the continuous paper 5 is wound on the take-up roller 67 of the paper output device 4. During the image forming operation, the continuous paper 5 fed from the paper feed device 3 is transported through the image output unit 2 at a required transport speed, and after that, contained in the paper output device 4.

The second transfer device 30 collectively transfers the toner images on the intermediate transfer belt 21 onto the continuous paper 5 through the second transfer at the second transfer position T2. Furthermore, the belt cleaner 26 cleans the surface of the intermediate transfer belt 21 by removing the adhering matter such as toners remaining on the surface of the intermediate transfer belt 21 after the second transfer has been performed in the intermediate transfer device 20 having undergone the second transfer.

Next, the continuous paper 5 onto which the toner images have been transferred through the second transfer is removed from the intermediate transfer belt 21 and the second transfer roller 31. Then, the continuous paper 5 is transported to the fixing device 40. The fixing device 40 performs the required fixing process (heating and applying pressure) so as to fix the unfixed toner images onto the label paper 5. At last, the label paper 5 having undergone the fixing is cooled by the cooling device 45. Then, the label paper 5 is output to the outside of the image output unit 2 and wound by the take-up roller 67 provided in the paper output device 4.

Through the above-described operation, the continuous paper 5 is output on which an image of full colors and the special colors made by combining the toner images of six colors has been formed.

A Structure of a Characteristic Part of the Image Forming Apparatus

FIG. 1 is a structural view of the image forming apparatus according to a first exemplary embodiment of the present invention.

As illustrated in FIG. 1, the continuous paper 5 wound in a roller shape is fed from the roll paper 62 of the paper feed device 3 in the image forming apparatus 1. In so doing, the roll paper 62 is placed under an environment where the image forming apparatus 1 is installed. In the case where the image forming apparatus 1 is installed under, for example, a high-temperature high-humidity environment, the roll paper 62 is placed under the high-temperature high-humidity environment. In the case where the image forming apparatus 1 is installed under, for example, a low-temperature low-humidity environment, the roll paper 62 is placed under the low-temperature low-humidity environment.

Accordingly, when the roll paper 62 is, for example, set in the paper feed device 3 and left unattended for a long time, the continuous paper 5 wound in the form of the roll paper 62 may, for example, absorb moisture under the high-temperature high-humidity environment. At this time, the continuous paper 5 wound in the form of the roll paper 62 does not uniformly absorb moisture under the high-temperature high-humidity environment. Part of the continuous paper 5 positioned at the outer circumference in the radial direction of the roll paper 62 tends to easily absorb moisture compared to part of the continuous paper 5 positioned on the inner circumference in the radial direction of the roll paper 62. Furthermore, parts of the continuous paper 5 positioned at both ends in the axial direction of the roll paper 62 tends to easily absorb moisture compared to part of the continuous paper 5 positioned at a central portion in the axial direction of the roll paper 62. As a result, in the case where, for example, the roll paper 62 is left unattended under the high-temperature high-humidity environment for a long time, the roll paper 62 may absorb moisture in a non-uniform manner in the radial direction and the axial direction of the roll paper 62, and accordingly, resistance of the continuous paper 5 having a large length may vary in accordance with positions in the continuous paper 5 transport direction and a direction intersecting the continuous paper 5 transport direction.

Figure 5:
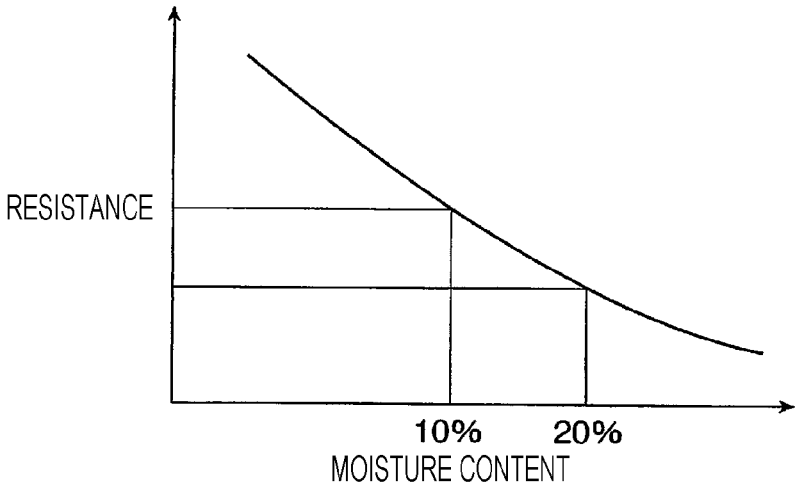
FIG. 5 is a graph illustrating the relationship between the moisture content and the resistance of the continuous paper.

FIG. 5 is a graph illustrating the relationship between the moisture content and the resistance (volume resistance) of the continuous paper 5. Here, when the weight of the continuous paper 5 is Ws and the weight of the water is Ww, the moisture content (moisture content rate) U of the continuous paper 5 is represented as follows:

$$U=\{Ww/(Ws+Ww)\}\times 100.$$

As illustrated in FIG. 5, when the moisture content of the continuous paper 5 increases, the resistance (volume resistance) tends to decrease, and conversely, when the moisture content decreases, the resistance (volume resistance) tends to increase.

In contrast, as illustrated in FIG. 4, the required second transfer bias voltage is applied by the second transfer device 30 at the second transfer position T2 in the image output unit 2 of the image forming apparatus 1. Accordingly, in the case where the resistance of the continuous paper 5 varies in accordance with, for example, the position in the transport direction, for example, the resistance of the continuous paper 5 is smaller than a typical value due to moisture absorption of the continuous paper 5, the transfer electric field does not necessarily sufficiently act on the toner images held by the intermediate transfer belt 21 when the required second transfer bias voltage is applied to the second transfer device 30. This may lead to poor transfer of the toner images transferred from the intermediate transfer belt 21 to the continuous paper 5.

Furthermore, under a low-temperature low-humidity environment, in the case where, for example, the resistance of the continuous paper 5 is larger than a typical value, the second transfer electric field may become excessive when the required second transfer bias voltage is applied to the second transfer device 30. This may lead to poor transfer such as, for example, dispersion of the toners in the toner images transferred from the intermediate transfer belt 21 to the continuous paper 5 caused by local discharging or the like.

In order to address this, a resistance detector 70 serving as an example of a resistance detection unit and the controller 100 serving as an example of a changing unit are provided according to the present exemplary embodiment. The resistance detector 70 detects the resistance of the continuous paper 5 at a position upstream of the second transfer device 30 in the continuous paper 5 transport direction. The controller 100 changes the transfer conditions of the second transfer device 30 in accordance with detection result of the resistance detector 70.

Figure 6A:
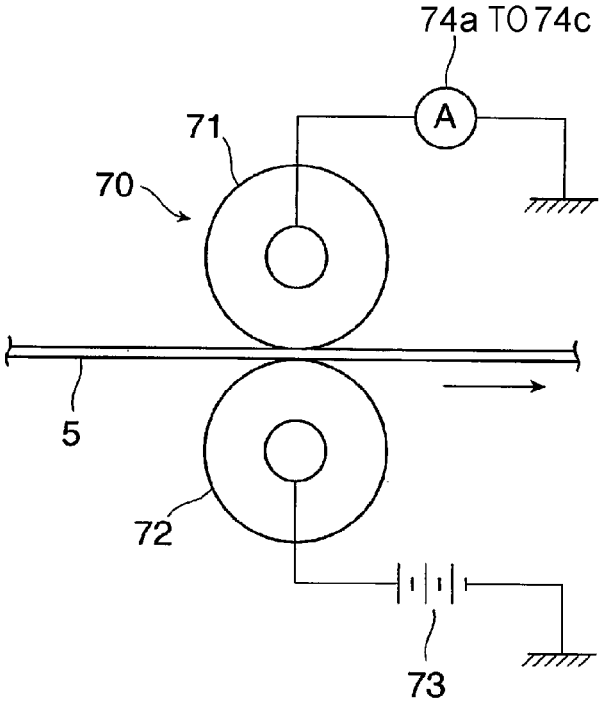
FIGS. 6A and 6B are structural views of a resistance detector.

As illustrated in FIG. 6A, the resistance detector 70 includes a pair of detection rollers 71 and 72 disposed such that the continuous paper 5 is interposed between the pair of detection rollers 71 and 72 with the front side and the back side of the continuous paper 5 facing the detection rollers 71 and 72. The pair of detection rollers 71 and 72 are formed of, for example, metal such as stainless steel so as to have a cylindrical shape having a comparatively small length in the axial direction. The pair of detection rollers 71 and 72 are rotatable and in contact with each other with required urging forces when no continuous paper 5 is transported between the pair of detection rollers 71 and 72.

Figure 6B:
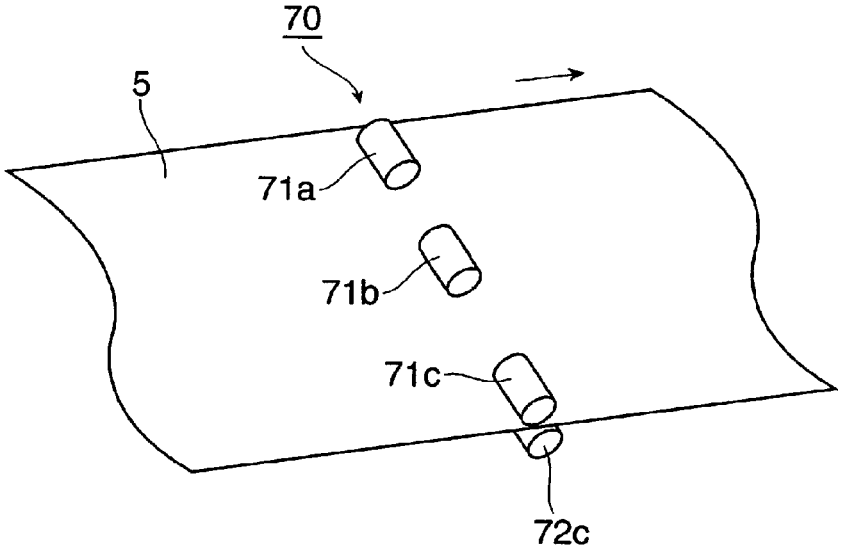

Furthermore, as illustrated in FIG. 6B, the pair of detection rollers 71 and 72 each include detection roller components. In an example illustrated in FIG. 6B, the detection roller components are disposed at a central portion and both end portions in a direction intersecting the continuous paper 5 transport direction. Detection roller components 72*a* to 72*c* of the detection roller 72 as one of the pair of detection rollers 71 and 72 are connected to a high-voltage power source 73. A predetermined high voltage for resistance detection is applied to the detection roller components 72*a* to 72*c* at required timing. Furthermore, detection roller components 71*a* to 71*c* of the detection roller 71 as the other of the pair of detection rollers 71 and 72 are respectively connected to ammeters 74*a* to 74*c* serving as current detection units. Detection values of the ammeters 74*a* to 74*c* are input to the controller 100.

The controller 100 detects amperages at the central portion and both the end portions in the direction intersecting the continuous paper 5 transport direction in accordance with detection signals from the ammeters 74*a* to 74*c* and obtains resistances R at the portions of the continuous paper 5 through computation in accordance with the amperages at the central portion and both the end portions. Furthermore, the controller 100 controls the second transfer bias voltage or current applied to the second transfer device 30 in accordance with the obtained resistances at the portions of the continuous paper 5. Here, before an image is formed on the continuous paper 5, the controller 100 causes the continuous paper 5 having known resistance to be interposed between the pair of detection rollers 71 and 72. Thus, calibration is performed by detecting the resistance of the continuous paper 5 that is known.

Figure 7:
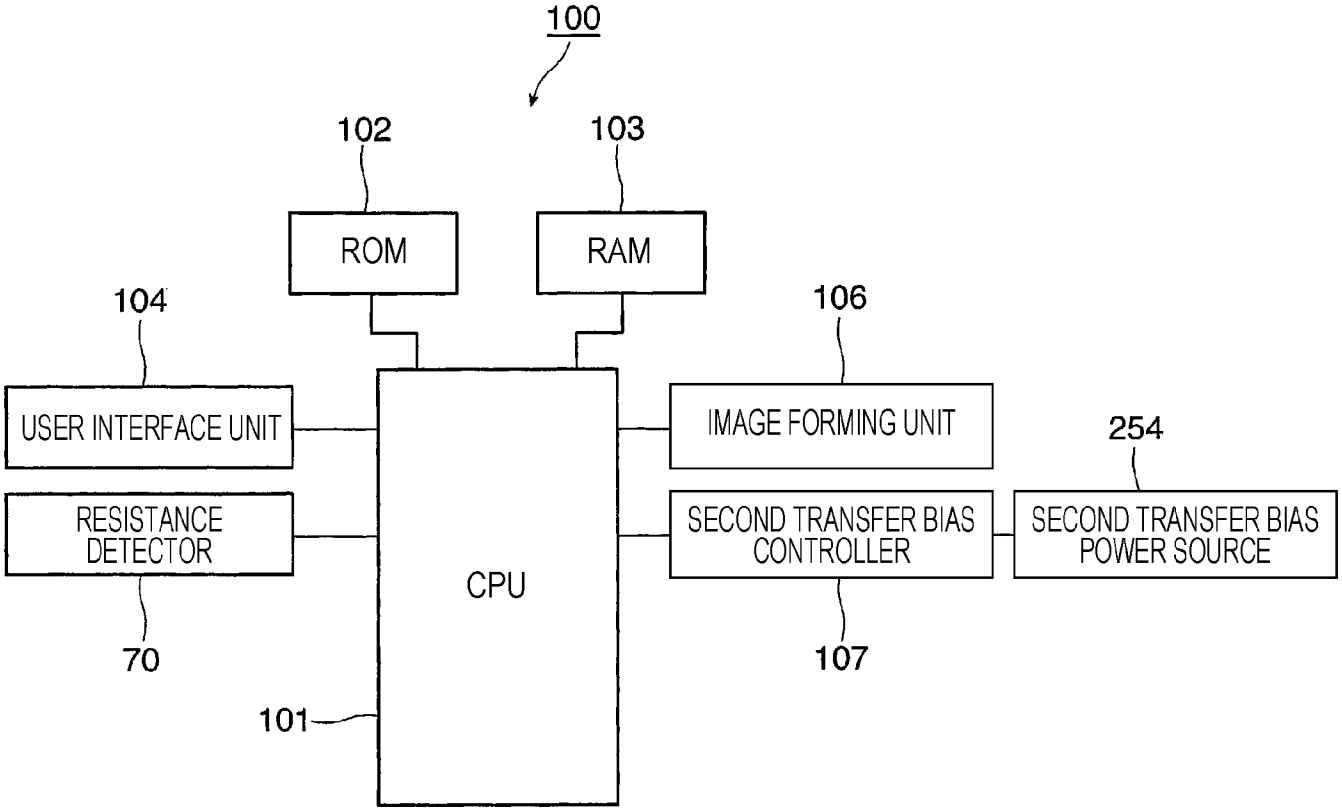
FIG. 7 is a block diagram of a controller of the image forming apparatus according to the first exemplary embodiment of the present invention.

FIG. 7 illustrates the controller that controls the operation of the image forming apparatus.

In FIG. 7, the controller that controls in a centralized manner the operation of the image forming apparatus 1 is indicated by numeral 100. The controller 100 includes, for example, a central processing unit (CPU) 101 that controls the operation of the image forming apparatus 1 in a centralized manner, a read only memory (ROM) 102 that stores a program executed by the CPU 101, a random access memory (RAM) 103 that temporarily stores control parameters and the like, buses through which the CPU 101, the ROM 102, and so forth are connected, and a communication interface.

Furthermore, the controller 100 detects amperages I at the central portion and both the end portions in the direction intersecting the continuous paper 5 transport direction in accordance with the detection signals from the ammeters 74*a* to 74*c* of the resistance detector 70 and obtains resistances R (V/I) at the central portion and both the end portions in the continuous paper 5 transport direction through computation in accordance with the voltage applied by the high-voltage power source 73. The controller 100, which obtains the resistances R at the central portion and both the end portions in the direction intersecting the continuous paper 5 transport direction through the computation, sets the average of the resistances R at the central portion and both the end portions as a resistance at a detection position in the continuous paper 5 transport direction.

Numeral 107 indicates a second transfer bias controller that controls the second transfer bias power source 254 in accordance with a control signal from the controller 100.

Numeral 104 indicates a user interface unit that allows a user to input and display the type, the size, the number of sheets to be printed, and so forth of the recording medium 5 on which an image is formed.

Operation of a Characteristic Part of the Image Forming Apparatus

In the image forming apparatus according to the first exemplary embodiment of the present invention, the second transfer bias voltage or current applied to the second transfer device 30 is controlled in accordance with the resistance of the continuous paper 5 as follows.

Referring to FIG. 1, along with the start of the image forming operation, the image forming apparatus 1 detects the resistance of the continuous paper 5 by using the resistance detector 70 so as to control the second transfer voltage or the second transfer current applied to the second transfer device 30.

As illustrated in FIG. 6A, the controller 100 causes the high-voltage power source 73 of the resistance detector 70 to apply a certain high voltage to the detection roller 72 being one of the pair of detection rollers 71 and 72 and causes the ammeters 74*a* to 74*c* to detect the amperage of the current flowing through the detection roller 71 being the other of the pair of detection rollers 71 and 72.

The controller 100 obtains the resistance of the continuous paper 5 through computation in accordance with the amperages detected by the ammeters 74*a* to 74*c*. Also, the controller 100 controls the second transfer bias voltage or current applied to the belt support roller 25 by the second transfer bias power source 254 in accordance with the obtained resistance of the continuous paper 5.

The controller 100 determines whether or not the obtained resistance of the continuous paper 5 is within a required allowable range. When it is determined that the obtained resistance of the continuous paper 5 is within the required allowable range, the controller 100 causes the second transfer bias power source 254 to apply a normal second transfer bias voltage to the belt support roller 25.

Furthermore, when it is determined that the obtained resistance of the continuous paper 5 is higher than the required allowable range, the controller 100 changes the second transfer bias voltage applied to the belt support roller 25 by the second transfer bias power source 254 to a higher voltage than the normal value. In contrast, when it is determined that the obtained resistance of the continuous paper 5 is lower than the required allowable range, the controller 100 changes the second transfer bias voltage applied to the belt support roller 25 by the second transfer bias power source 254 to a lower voltage than the normal value.

As described above, the second transfer bias voltage applied to the belt support roller 25 by the second transfer bias power source 254 is controlled in accordance with the detected resistance of the continuous paper 5 according to the first exemplary embodiment. In this way, even in the case where, for example, the resistance of the continuous paper 5 is lower than a normal value due to moisture absorption of the continuous paper 5, an appropriate second transfer bias voltage may be applied to the second transfer device 30. Thus, the occurrence of poor transfer in the toner images transferred onto the continuous paper 5 and the occurrence of poor transfer such as dispersion of the toners due to excessive second transfer electric field may be prevented or suppressed.

Second Exemplary Embodiment

Figure 8:
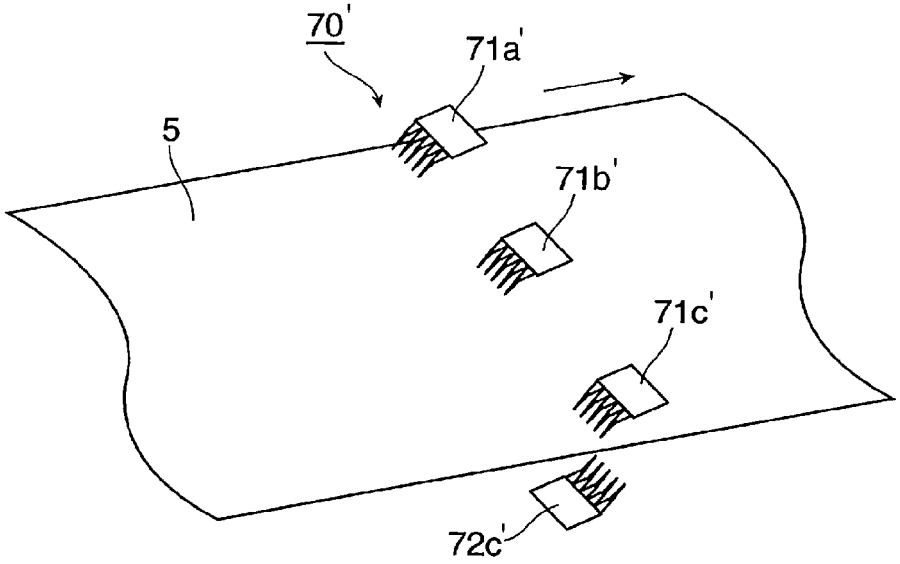
FIG. 8 is a structural view of a resistance detector of the image forming apparatus according to a second exemplary embodiment of the present invention.

FIG. 8 illustrates part of the image forming apparatus according to a second exemplary embodiment.

According to the second exemplary embodiment, as illustrated in FIG. 8, a resistance detection member of a resistance detector 70' includes brush-shaped electrodes 71' and 72' disposed on the front side and the back side of the continuous paper 5 in a contactless manner. A required high-voltage is applied to brush-shaped electrode components 72*a'* to 72*c'* by the high-voltage power source 73 of the resistance detector 70', and other brush-shaped electrode components 71*a'* to 71*c'* are connected to the respective ammeters 74*a* to 74*c*.

Third Exemplary Embodiment

Figure 9:
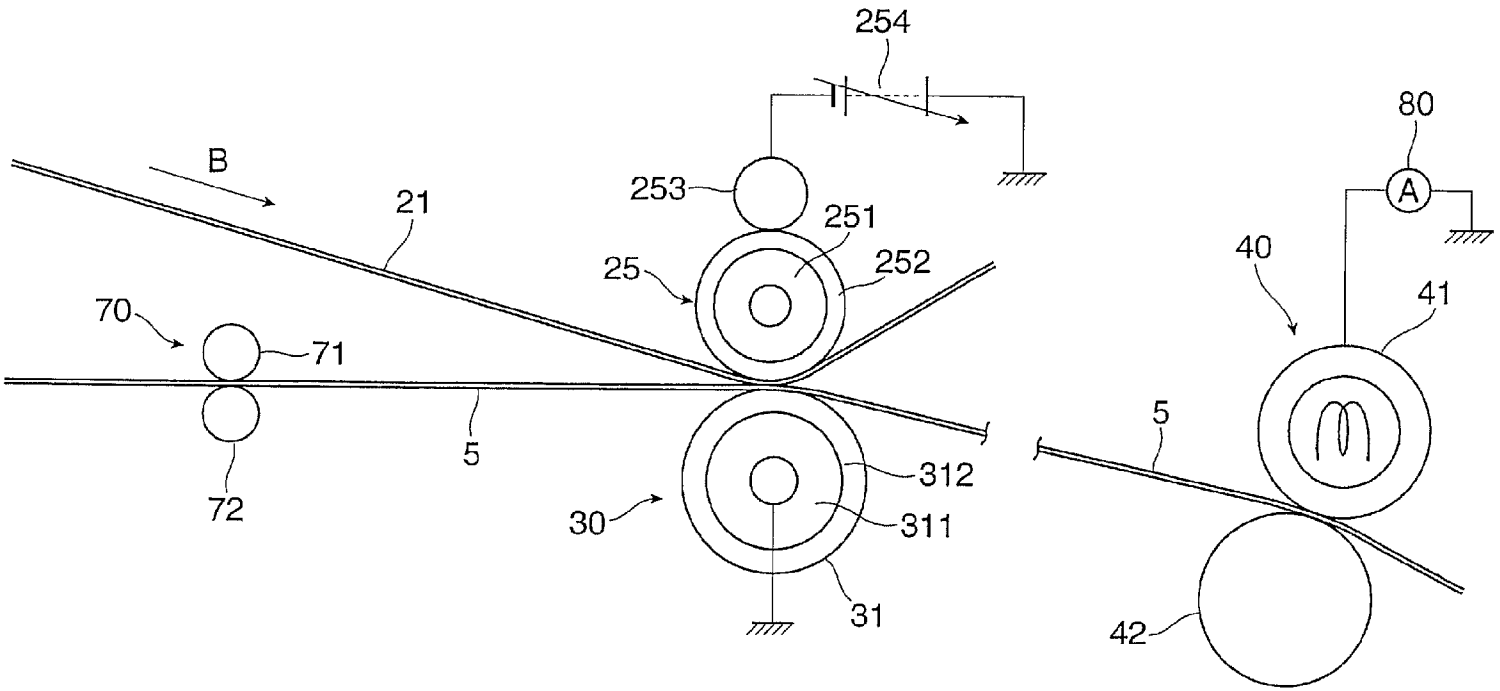
FIG. 9 is a structural view of part of the image forming apparatus according to a third exemplary embodiment of the present invention.

FIG. 9 illustrates part of the image forming apparatus according to a third exemplary embodiment.

According to the third exemplary embodiment, as illustrated in FIG. 9, a leakage ammeter 80 serving as an example of a leakage current detection unit is provided. The leakage ammeter 80 detects a leakage current leaking from the second transfer device 30 to the fixing device 40. The leakage ammeter 80 is interposed between, for example, the ground potential and a metal cored bar of the heating rotating member 41 of the fixing device 40. The second transfer current leaks to the fixing device 40 through the continuous paper 5, and this leakage current flows to the metal cored bar of the heating rotating member 41. The leakage ammeter 80 detects this leakage current. The surface of the heating rotating member 41 of the fixing device 40 may be coated with an elastic layer. The elastic layer of the heating rotating member 41 may have electrical conductivity so as to prevent, for example, offset of the toners caused by charging of the elastic layer. Thus, leakage current is detectable by detecting the current flowing to the cored bar through the electrically conductive elastic layer in the heating rotating member 41.

In addition to the control in accordance with the resistance of the continuous paper 5, the controller 100 may suppress, in accordance with the detection value of the leakage ammeter 80, the occurrence of poor transfer caused by the leakage current leaking to the fixing device 40 through the continuous paper 5. In accordance with the detection value of the leakage ammeter 80, the controller 100 controls the second transfer bias voltage or current applied to the second transfer device 30 so as to cancel out the leakage current.

Fourth Exemplary Embodiment

Figure 10:
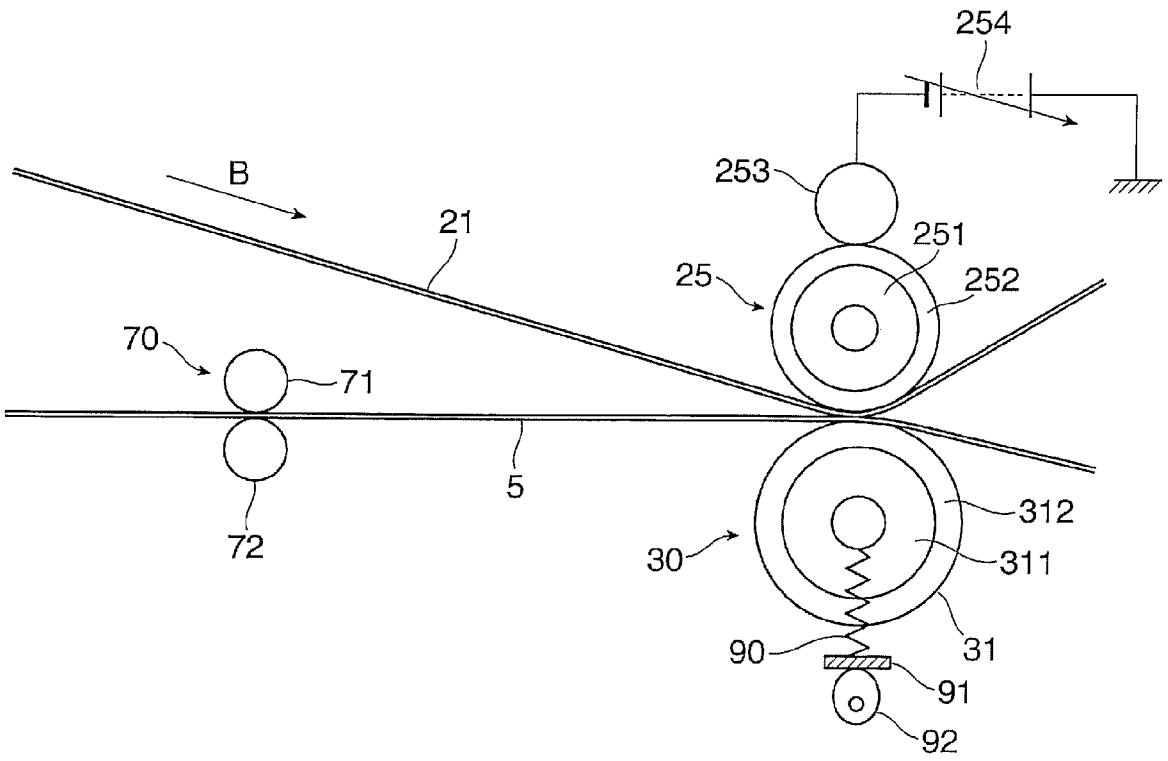
FIG. 10 is a structural view of part of the image forming apparatus according to a fourth exemplary embodiment of the present invention.

FIG. 10 illustrates part of the image forming apparatus according to a fourth exemplary embodiment.

According to the fourth exemplary embodiment, as illustrated in FIG. 10, the changing unit changes a transfer nip width of the second transfer device 30. The belt support roller 25 is rotatably disposed at a fixed position in the housing 2*a* of the image output unit 2. In contrast, the second transfer roller 31 of the second transfer device 30 is rotatable and movable in a direction in which the second transfer roller 31 is moved toward and separated from the belt support roller 25. The second transfer roller 31 is urged in a direction in which the second transfer roller 31 is moved toward the belt support roller 25 by a coil spring 90 serving as an example of an urging member. One end portion of the coil spring 90 is supported by a support plate 91. Furthermore, an eccentric cam 92 rotated by a drive unit (not illustrated) is in contact with the support plate 91.

The coil spring 90 is displaced in a direction in which the coil spring 90 is moved toward and separated from the belt support roller 25 through the support plate 91 by rotating the eccentric cam 92. Thus, rotating the eccentric cam 92 changes, through the displacing coil spring 90, a contact pressure with which the second transfer roller 31 is in contact with the belt support roller 25, and accordingly, the transfer nip width is able to be changed.

According to the fourth exemplary embodiment, the controller 100 determines whether or not the resistance of the continuous paper 5 is within the required allowable range. When it is determined that the resistance of the continuous paper 5 is within the required allowable range, the controller 100 causes the eccentric cam 92 to rotate to an intermediate position, thereby the contact pressure with which the second transfer roller 31 is in contact with the belt support roller 25 is set to a normal value.

Furthermore, when it is determined that the resistance of the continuous paper 5 is higher than the required allowable range, the controller 100 causes the eccentric cam 92 rotate to a pressure contact position, thereby the contact pressure with which the second transfer roller 31 is in pressure contact with the belt support roller 25 is switched to a lower value than the normal value so as to increase the transfer nip width. In contrast, when it is determined that the obtained resistance of the continuous paper 5 is lower than the required allowable range, the controller 100 causes the eccentric cam 92 to rotate to a separating position, thereby the contact pressure with which the second transfer roller 31 is in pressure contact with the belt support roller 25 is switched to a higher value than the normal value so as to decrease the transfer nip width.

In this way, according to the above-described fourth exemplary embodiment, the transfer nip width of the second transfer device 30 is changed in accordance with the detected resistance of the continuous paper 5. Thus, even in the case where, for example, the resistance of the continuous paper 5 is lower than the normal value due to moisture absorption of the continuous paper 5, the second transfer device 30 may be set to have an appropriate transfer nip width. Accordingly, the occurrence of poor transfer in the toner images transferred onto the continuous paper 5 and the occurrence of poor transfer such as dispersion of the toners due to excessive second transfer electric field may be prevented or suppressed.

Fifth Exemplary Embodiment

According to a fifth exemplary embodiment, the controller 100 determines the position of an image to be transferred onto the continuous paper 5 in accordance with the image information.

It is assumed that the controller 100 determines that the position of an image to be transferred onto the continuous paper 5 is positioned only at, for example, a left end portion in the direction intersecting the continuous paper 5 transport direction in accordance with the image information. Referring to FIG. 6B, in this case, the second transfer bias voltage or current at the second transfer device 30 is controlled in accordance with detection results of only the detection roller components 71*a* and 72*a* positioned at the left end portion of the resistance detector 70 in the direction intersecting the continuous paper 5 transport direction.

According to the exemplary embodiments having been described, the image forming apparatus is a full-color image forming apparatus that forms toner images of six colors including yellow (Y), magenta (M), cyan (C), black (K), the first special color (S1), and the second special color (S2). However, this is not limiting. Of course, technique described herein is similarly able to be used for a full-color image forming apparatus that forms toner images of four colors including yellow (Y), magenta (M), cyan (C), and black (K) or an image forming apparatus that forms monochrome images.

Furthermore, although the technique is used for the second transfer device according to the exemplary embodiments having been described, the technique is able to be similarly used for the first transfer device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit configured to transfer an image to a continuous recording medium;

a resistance detection unit configured to detect a resistance of the recording medium at a position upstream of the transfer unit in a transport direction of the recording medium; and a changing unit configured to change a transfer condition of the transfer unit in accordance with a detection result of the resistance detection unit, wherein the changing unit is configured to change a transfer voltage or a transfer current applied to the transfer unit, and wherein the changing unit is configured to, in response to the detected resistance of the recording medium being lower than a reference value, increase the transfer voltage or the transfer current applied to the transfer unit.

2. The image forming apparatus according to claim 1, further comprising:

a fixing unit configured to fix the image having been transferred to the recording medium; and a leakage current detection unit configured to detect a leakage current leaking from the transfer unit to the fixing unit, wherein the changing unit is configured to change the transfer condition of the transfer unit in accordance with the detection result of the resistance detection unit and a detection result of the leakage current detection unit.

3. The image forming apparatus according to claim 1, wherein the changing unit is configured to change the transfer condition of the transfer unit in accordance with a position of the image to be transferred to the recording medium.

4. An image forming apparatus comprising:

a transfer unit configured to transfer an image to a continuous recording medium;

a resistance detection unit configured to detect a resistance of the recording medium at a position upstream of the transfer unit in a transport direction of the recording medium; and a changing unit configured to change a transfer condition of the transfer unit in accordance with a detection result of the resistance detection unit, wherein the changing unit is configured to change a transfer nip width of the transfer unit.

5. The image forming apparatus according to claim 4, wherein the changing unit is configured to, in response to the detected resistance of the recording medium being lower than a reference value, increase the transfer nip width of the transfer unit.

6. An image forming apparatus comprising:

a transfer unit configured to transfer an image to a continuous recording medium;

a resistance detection unit configured to detect a resistance of the recording medium at a position upstream of the transfer unit in a transport direction of the recording medium; and a changing unit configured to change a transfer condition of the transfer unit in accordance with a detection result of the resistance detection unit, wherein the resistance detection unit is configured to detect resistances of the recording medium at a plurality of positions in a direction intersecting the transport direction of the recording medium.

* * * * *